United States Patent [19]

Hayashi

[11] 4,394,850

[45] Jul. 26, 1983

[54] CYLINDER BLOCK FOR AUTOMOTIVE INTERNAL COMBUSTION ENGINE

[75] Inventor: Yoshimasa Hayashi, Kamakura, Japan

[73] Assignee: Nissan Motor Company, Limited, Yokohama City, Japan

[21] Appl. No.: 302,238

[22] Filed: Sep. 14, 1981

[30] Foreign Application Priority Data

Sep. 16, 1980 [JP] Japan ..... 55-128400
Sep. 17, 1980 [JP] Japan ..... 55-131882[U]

[51] Int. Cl.[3] ..... F01P 3/02
[52] U.S. Cl. ..... 123/41.74; 123/193 C
[58] Field of Search ..... 123/41.72, 41.74, 41.79, 123/193 C, 193 CH, 193 CP

[56] References Cited

U.S. PATENT DOCUMENTS

| | | | |
|---|---|---|---|
| 2,681,054 | 4/1951 | Boghossian | 123/41.74 |
| 2,960,974 | 11/1960 | Olsen et al. | 123/41.74 |
| 3,942,487 | 3/1976 | Zink | 123/41.74 |
| 4,175,503 | 6/1978 | Ernest | 123/41.72 |

FOREIGN PATENT DOCUMENTS

| | | |
|---|---|---|
| 2850884 | 5/1980 | Fed. Rep. of Germany . |
| 387381 | 3/1962 | Switzerland . |
| 2065765 | 11/1980 | United Kingdom . |

*Primary Examiner*—William A. Cuchlinski, Jr.
*Attorney, Agent, or Firm*—Schwartz, Jeffery, Schwaab, Mack, Blumenthal & Koch

[57] ABSTRACT

A cylinder block for an automotive in-line multiple-cylinder internal combustion engine, comprising an outer wall structure, an elongate cylinder row structure spacedly located within the outer wall structure including a plurality of cylinder sections whose neighboring cylinder sections are integrally connected with each other, and first and second connecting wall portions which integrally connect the cylinder sections at the extremities of the cylinder row structure with the outer wall structure so as to define independent coolant passages at the opposite sides of the cylinder row structure, thereby improving flexural and tortional rigidities though produced by die-casting.

7 Claims, 9 Drawing Figures

CYLINDER BLOCK FOR AUTOMOTIVE INTERNAL COMBUSTION ENGINE

BACKGROUND OF THE INVENTION

1. Field of the Invention

This invention relates to a cylinder block for an internal combustion engine, and more particularly to a cylinder block made of light alloy and produced by die-casting.

2. Description of the Prior Art

It is well known to die cast a cylinder block using a light alloy such as aluminum alloy as a material thereof. Such a die-cast cylinder block is not provided with an upper deck section, so that the top section of each engine cylinder is not integrally connected to an outer wall structural of the cylinder block. In this connection, the upper deck section in a cylinder block produced by conventional casting using molding sand is provided with such a upper deck section which serves to integrally connect each engine cylinder top section and the outer wall section of the cylinder block. The reason why the deck section is not provided in the die-cast cylinder block is that a metallic die for forming the water jacket is pulled up during die-casting thereof. As a result, the upper section of each engine cylinder is not integral with the outer wall section of the cylinder block and is accordingly, free from secure restraint. This leads to a reduction in flexural and which results in vibrations and, thus, of the cylinder block, thereby readily vibrating to generate noise.

BRIEF SUMMARY OF THE INVENTION

In accordance with the present invention, a cylinder block for an automotive in-line multiple-cylinder internal combustion engine comprises outer wall means including oppositely located first and second end wall sections, and oppositely located first and second side wall sections, the top surface of the wall sections being continuous and lying on a common plane. The cylinder block further comprises an elongate cylinder row structure spacedly located within the outer wall means and including a plurality of cylinder sections whose neighbouring cylinder sections are integrally connected with each other. The cylinder sections contain first and second extreme cylinder sections located at the opposite extremities of the cylinder row structure and positioned in the vicinity of the first and second end wall sections of the outer wall means, each cylinder section being formed with a cylinder bore therein. The top surface of the cylinder row structure lies on the above-mentioned common plane. The first extreme cylinder section is integrally connected with the first end wall section of the outer wall means. The second extreme cylinder section is integrally connected with the second end wall section of said outer wall means. Accordingly, first and second coolant passages are formed separately and independently from each other. Each coolant passage is defined between the side wall section and the cylinder row structure.

The thus arranged cylinder block has greatly improved flexural and tortional rigidity though produced by die-casting, thereby suppressing noise due to cylinder block vibration. Also, the coolant flow to two coolant passages located at the opposite sides relative to the cylinder row structure is controllable to improve cooling characteristics of the engine.

BRIEF DESCRIPTION OF THE DRAWINGS

The features and advantages of the cylinder block according to the present invention will be more clearly appreciated from the following description taken in conjunction with the accompanying drawings in which like reference numerals designate like parts and elements, in which.

DETAILED DESCRIPTION OF THE INVENTION

Figure 1:
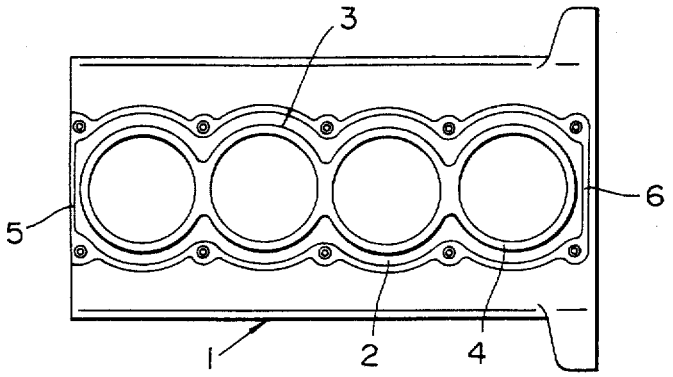
FIG. 1 PRIOR ART
FIG. 1 is a plan view of a cylinder block of a conventional in-line four-cylinder internal combustion engine.
Figure 2:
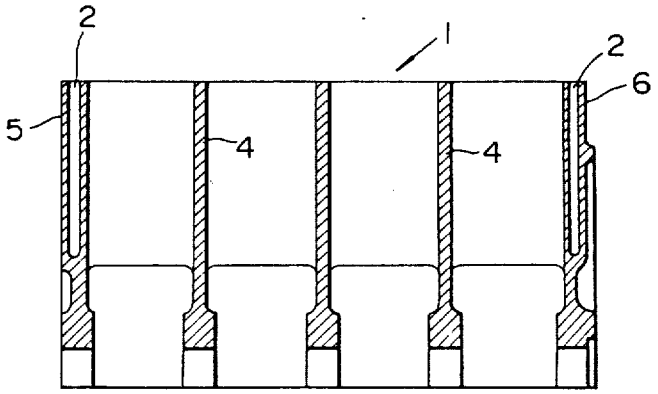
FIG. 2 PRIOR ART
FIG. 2 is a vertical cross-sectional view of the cylinder block of FIG. 1.

To facilitate understanding the present invention, a brief reference will be made to a conventional cylinder block 1 made of light alloy, depicted in FIGS. 1 and 2. The cylinder block 1 of this kind is formed without an upper deck section to which a cylinder head (not shown) is secured, i.e., an engine coolant passage fully opens to the top surface of the cylinder head. This is because the metallic die used to form the coolant passage core, during casting by using molding sand, is removed upwardly to leave a cylinder row structure 3 during die-casting. In the cylinder row structure 3, neighbouring cylinder sections 4 are connected integrally with each other to increase the rigidity of the cylinder row structure and to shorten the whole length of the cylinder block 1. Otherwise, each cylinder section 4 may be independent and separate from each other.

With such a conventional cylinder block, the upper deck section is not provided and the opposite extremities of the cylinder row structure 3 do not connect respectively with the front and rear wall sections 5, 6 and accordingly the major part of the cylinder sections 4 are not restrained relative to the body of the cylinder block 1. This causes a low rigidity against flexure in the vertical and lateral directions, distortion and the like of the cylinder block itself, with the result that the cylinder block 1 readily vibrates due to engine piston movements and combustion in engine cylinders. Particularly, the front wall section 5 of the cylinder block 1 to which a timing cover (not shown) is attached, tends to readily vibrate, thereby generating a high level noise. Additionally, with of the conventional cylinder block 1, the rigidity of the connection of a transmission (not shown) to the cylinder block rear wall section 6 is low and therefore, the natural vibration frequency of the combined cylinder block and transmission becomes lower, thereby resulting in an increase in passenger compartment noise of a low frequency range.

Figure 3:
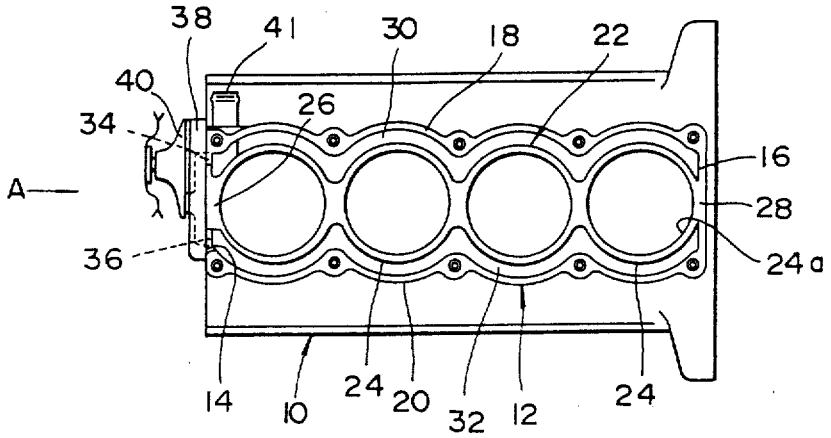
FIG. 3 is a plan view of an embodiment of a cylinder block in accordance with the present invention.
Figure 4:
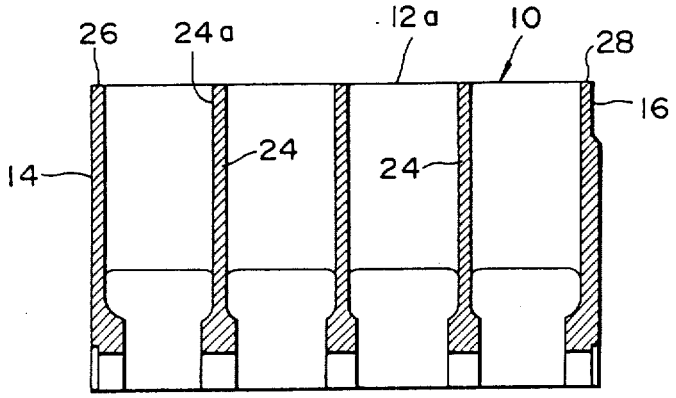
FIG. 4 is a vertical cross-sectional view of the cylinder block of FIG. 3.
Figure 5:
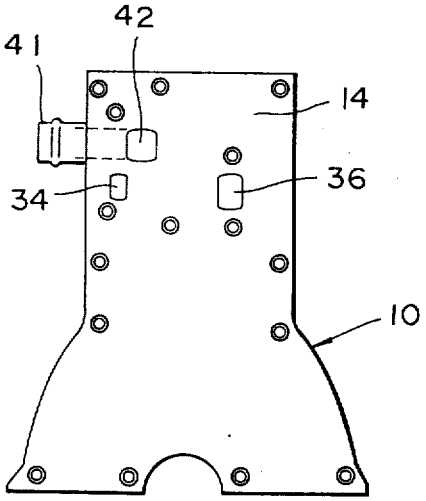
FIG. 5 is a side view of the cylinder block, with the coolant pump removed, as viewed from the direction of an arrow A of FIG. 3.
Figure 6:
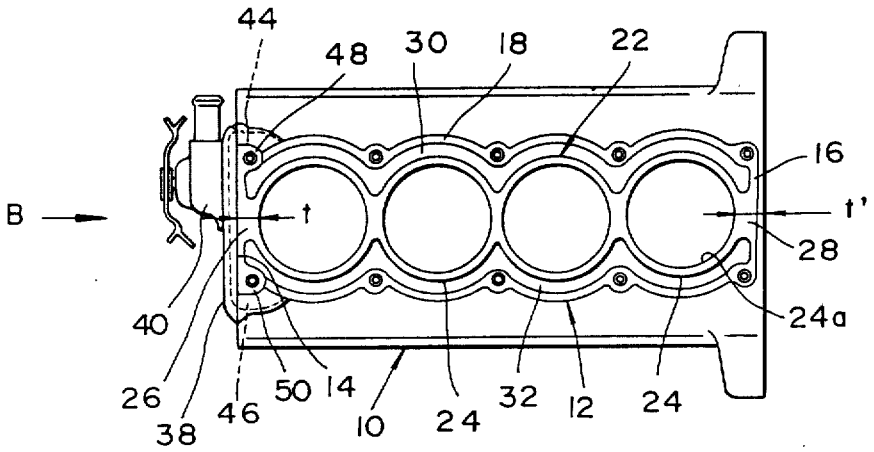
FIG. 6 is a plan view of another embodiment of the cylinder block in accordance with the present invention.
Figure 7:
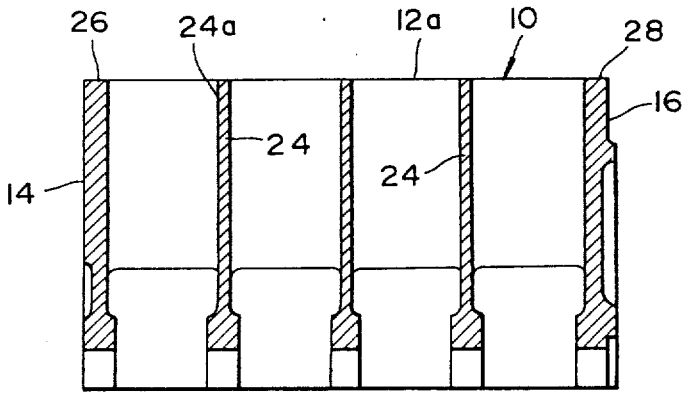
FIG. 7 is a vertical sectional view of the cylinder block of FIG. 6.
Figure 8:
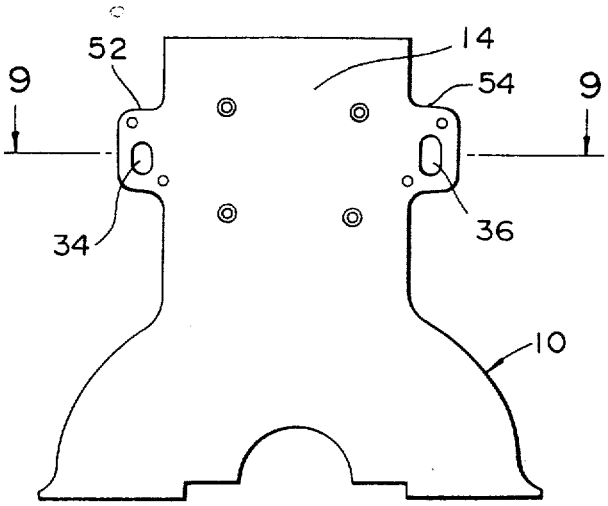
FIG. 8 is a side view of the cylinder block, with the coolant pump removed, as viewed from the direction of an arrow B of FIG. 6.
Figure 9:
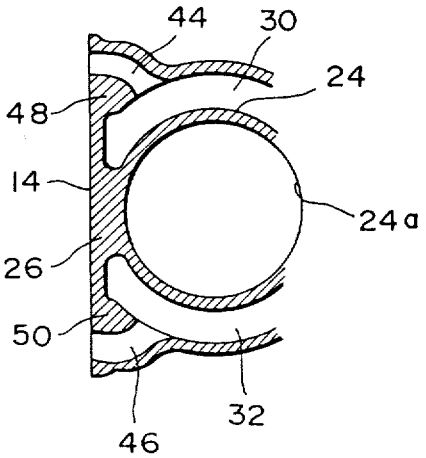
FIG. 9 is a cross-sectional view taken in the direction of the arrows substantially along the line 9—9 of FIG. 8.

In view of the above description of the conventional cylinder block construction, reference is now made to FIGS. 3 to 5, wherein an embodiment of a cylinder block according to the present invention is illustrated by the reference numeral 10. The cylinder block 10 is made of a light alloy such as aluminum alloy and produced by die-casting, which cylinder block is used for an automotive in-line multiple-cylinder internal combustion engine. The cylinder block 10 comprises an outer vertical wall structure 12 including oppositely located front and rear wall sections 14, 16, and oppositely located right-side and left-side side wall sections 18, 20. The wall sections 14, 16, 18, 20 are continuous and integral with each other, and their top surfaces lie on a common plane 12*a*. It will be understood that a cylinder head (not shown) is secured on this common plane 12*a* of the cylinder block 10.

A cylinder row structure 22 includes, in this instance, four cylinder sections 24 which are connected integrally with each other and aligned in a row. Each cylinder section 24 is formed therein with a cylinder bore 24*a* within which a piston (not shown) is locatable. The surface of the cylinder bore 24*a* may be covered with a cylinder liner. The cylinder row structure 22 is spacedly located within the outer wall structure 12, in which the wall sections 14, 16, 18, 20 are generally parallel with the axis of each cylinder section 24 of the cylinder row structure 22. Additionally, the cylinder row structure 22 is connected integrally at its opposite extreme end sections with the front and rear end wall sections 14, 16, by means of front and rear connecting wall sections 26, 28, respectively. In other words, the cylinder sections 24 located at the opposite extremities of the cylinder row structure 22 are connected integrally with the front and rear end wall sections 14, 16 by the front and rear connecting wall sections 26, 28, respectively. It will be understood that the front and rear connecting wall sections 26, 28 may not be prominent so that the cylinder section 24 is merely connected integrally with the front or rear wall section 14, 16 of the outer wall structure 12. The top surface of the cylinder row structure or the cylinder sections 24 and the connecting wall sections 26, 28 lie on the common plane 12*a*. Accordingly, separate right-side and left-side engine coolant passages 30, 32 or water jackets are defined by the connecting wall sections 26, 28 and between the inner wall surface of the outer wall structure 12 and the outer wall surface of the cylinder row structure 22. In other words, the right-side and left-side coolant passages 30, 32 are formed oppositely relative to the cylinder row structure 22, and separate and independent from each other. As shown, the coolant passages 30, 32 fully open at the common plane 12*a*. It will be understood that each coolant passage 30, 32 is formed by extracting or drawing up a metallic die corresponding to the coolant passage during its production by die-casting.

As best seen in FIG. 5, the front wall section 14 of the outer wall structure 12 is formed with coolant inlet openings 34, 36 which are in communication with the right-side and left-side coolant passages 30, 32, respectively. It will be understood that engine coolant is introduced through these openings 34, 36 into the coolant passages 30, 32, respectively. These coolant inlet openings 34, 36 are formed during die-casting or by machining after die-casting. The right-side and left-side coolant passages 30, 32 may be in communication with each other through a small hole which is formed, for example by drilling, through a wall section between the neighbouring cylinder sections 24, in order to obtain a small amount of coolant flow between the right-side and left-side coolant passages 30, 32. More specifically, the cross-sectional area of the coolant inlet opening 36 is larger than that of the other coolant inlet opening 34, so that the coolant flow amount to the left-side coolant passage 32 is controlled larger than that to the right-side coolant passage 30. These coolant inlet openings 34, 36 communicate through a coolant distributor member 38 with a coolant pump 40 secured to the front wall section 14 of the cylinder block 10. The reference numeral 41 denotes a coolant suction pipe connected to a coolant radiator (not shown). The coolant suction pipe 41 is in communication with a coolant suction opening 42 formed through the front wall section 14. Accordingly, the engine coolant is sucked through the suction pipe 41 and the suction opening 42 into the coolant pump 40 and then distributed into the right-side and left-side coolant passages 30, 32 through the coolant inlet openings 34, 36 under the action of the distributor member 38.

In the thus arranged cylinder block, the neighbouring cylinder sections 24 are integrally connected with each other to form the cylinder row structure 22, and the opposite extremities of the cylinder row structure 22 are integrally connected respectively to the front and rear wall sections 14, 16 of the cylinder block 10. As a result, the cylinder block 10 has a strength which is generally equal to that of a conventional cylinder block which is provided with its upper deck section on which a cylinder head is securely mounted. Additionally, the bore pitch or distance between the neighbouring cylinder sections 24 can be reduced to shorten the whole length of the cylinder block 10. Therefore, the cylinder block 10 has improved rigidity against flexure in the vertical and lateral directions and distortion thereof. This suppresses generation of noises due to low cylinder block rigidity. Furthermore, from the point of view that a transmission (not shown) is secured to the rear end section or the rear wall section 16 of the cylinder block 10, the above-mentioned configuration of the cylinder block 10 greatly contributes to an improvement in the connection rigidity or strength between the cylinder block and the transmission since the front and rear wall sections 14, 16 are connected through the cylinder row structure 22. This greatly decreases low frequency noise within a passenger compartment, and extends the critical rotational speed of a propeller shaft (not shown).

Also, by differentiating the sectional area of the coolant inlet openings 34, 36 formed at the front wall section 14 of the cylinder block 10, the amounts of engine coolant supplied to the right-side and left-side coolant passages 30, 32 are controllable. Thus, the exhaust side of the engine can be predominantly cooled in an engine of the cross-flow induction-exhaust type in which intake and exhaust systems are respectively located at the opposite sides of the engine body. More specifically, in this instance, the coolant inlet opening 36 for the left-side coolant passage 32 located near the exhaust system is larger than the inlet opening 34 for the right-side coolant passage 30 located near the intake system. With this arrangement, a larger amount of engine coolant is supplied to the exhaust system side coolant passage 32 of the cylinder block 10, thereby maintaining the temperatures at the various sections of the engine uniform.

This prevents the generation of excessive thermal stress and strain due to temperature difference.

FIGS. 6, 7, 8 and 9 illustrate another embodiment of the cylinder block according to the present invention. In this embodiment, a right-side coolant inlet passage 44 communicating with the right-side coolant passage 30 is formed outside of a boss portion 48 for supporting a cylinder head bolt (not shown), and opens through the coolant inlet opening 34 at the front wall section 14 of the cylinder block 10. Similarly, a left-side coolant inlet passage 14 communicating with the left-side coolant passage 32 is formed outside of a boss portion 50 for supporting a cylinder head bolt (not shown), and opens through the coolant inlet opening 36 at the cylinder block front wall section 14. As shown, the coolant inlet openings 34, 36 are formed at projecting sections 52, 54 which project respectively from the right- and left-sides of the cylinder block front wall section 14. It will be understood that the coolant inlet openings 34, 36 are formed considerably spaced apart from the axis of cylinder block 10 as compared with in the above-mentioned embodiment of FIGS. 3 to 5. The coolant pump 40 secured on the cylinder block front wall section 14 is communicates through the distributor member 38 with the coolant inlet openings 34, 36, so that engine coolant supplied from the coolant pump 40 is distributed into the two coolant inlet openings 34, 36 to be introduced into the right-side and left-side coolant passages 30, 32.

In the thus arranged cylinder block 10, by virtue of the fact that the coolant inlet passages 44 and 46 are formed outside of the cylinder head bolt boss portions 48, 50, there are no holes for engine coolant flow at the cylinder block front wall section 14 to which a timing cover (not shown) is securely attached. As a result, the rigidity or strength of the front wall section 14 can be further improved, which decreases the vibration transmitted to the timing cover, thereby suppressing noise generation at the timing cover. Besides, as compared with the cylinder block provided with the openings for coolant flow through the cylinder block front wall section 14, the wall thicknesses, indicated by t and t', of the cylinder block front and rear end sections are allowed to decrease, which enables a further shortening of the whole length of the cylinder block 10.

As appreciated from the above, according to the present invention, the cylinder block is improved in rigidity or strength against flexure and distortion, thereby decreasing engine noise. Furthermore, it is possible to improve the connection rigidity of the transmission to the cylinder block. Moreover, cooling characteristics of the engine can be improved by differentiating the sectional areas of the cooling inlet openings of the separate coolant passages formed oppositely of the cylinder row structure.

What is claimed is:

1. A cylinder block for an automotive in-line multiple-cylinder internal combustion engine, comprising:

outer wall means including oppositely located first and second end wall sections, and oppositely located first and second side wall sections, the top surface of said wall sections being continuous and lying on a common plane;

an elongate cylinder row structure spacedly located within said outer wall means, said cylinder row structure including a plurality of cylinder sections whose neighbouring cylinder sections are integrally connected with each other, said cylinder sections containing first and second extreme cylinder sections located at the opposite extremities of said cylinder row structure and positioned in the vicinity of said first and second end wall sections of said outer wall means, each cylinder section being formed with a cylinder bore therein, the top surface of said cylinder row structure lying on said common plane; and first and second connecting wall means located between said outer wall means and said cylinder row structure, said first connecting wall means integrally connecting said first extreme cylinder section with said first end wall section, said second connecting wall means integrally connecting said second extreme cylinder section with said second end wall section of said outer wall means, thereby forming first and second coolant passages which are separate and independent from each other, each coolant passage being defined between said side wall section and said cylinder row structure, the top surface of each connecting wall means lying on said common plane.

2. A cylinder block as claimed in claim 1, further comprising means defining first and second coolant inlet openings at said first end wall section of said outer wall means, said first and second coolant inlet openings being in communication with said first and second coolant passages.

3. A cylinder block as claimed in claim 2, said first coolant inlet opening is smaller in cross-sectional area than the second coolant inlet opening, in which the coolant in said second coolant passage contributes to cooling an exhaust system of the engine.

4. A cylinder block as claimed in claim 1, wherein said outer wall means includes oppositely located first and second boss portions formed integrally with said first end wall section, each boss portion securely supporting a cylinder head bolt thereby, in which further comprising means defining first and second coolant inlet passages each of which establishes communication between said coolant passage and said coolant inlet opening, said first and second coolant inlet passages being formed outside of said first and second boss portions, respectively, whereby first and second coolant inlet openings are formed spaced from the central section of said first end wall section.

5. A cylinder block as claimed in claim 2, further comprising a coolant pump secured to said first end wall section of said outer wall means, and a distributor member secured onto said first end wall section to establish communication between said coolant pump and said first and second coolant inlet openings so as to distribute coolant fed from said coolant pump into the first and second coolant inlet openings.

6. A cylinder block as claimed in claim 1, wherein said cylinder block is produced by die-casting, in which said first and second coolant passages are formed by drawing out metallic dies through said common plane in the direction of the axis of said cylinder bore.

7. A cylinder block as claimed in claim 6, wherein said cylinder block is made of light alloy.

* * * * *